US005535812A

United States Patent [19]

Singleton

[11] Patent Number: 5,535,812

[45] Date of Patent: Jul. 16, 1996

[54] METHOD OF AND APPARATUS FOR CONTINUOUS CASTING OF METAL

[75] Inventor: Ogle R. Singleton, Richmond, Va.

[73] Assignee: Singleton Technology, Inc., Richmond, Va.

[21] Appl. No.: 369,918

[22] Filed: Jan. 6, 1995

[51] Int. Cl.[6] ..... B22D 11/06; B22D 7/10; B22D 11/10

[52] U.S. Cl. ..... 164/479; 164/429; 164/423; 164/122.1; 164/415

[58] Field of Search ..... 164/479, 429, 164/463, 423, 475, 415, 122.2, 472, 122.1

[56] References Cited

U.S. PATENT DOCUMENTS

| | | | |
|---|---|---|---|
| 3,322,184 | 9/1964 | Cofer et al. | 164/268 |
| 3,338,295 | 8/1967 | Scribner | 164/88 |
| 3,450,188 | 6/1969 | Vallak et al. | 164/122 |
| 3,519,062 | 7/1970 | Wertli | 164/283 |
| 3,623,535 | 11/1971 | Lenaeus | 164/87 |
| 3,838,729 | 10/1974 | Daigne et al. | 164/50 |
| 3,976,117 | 8/1976 | Olsson | 164/48 |
| 4,301,855 | 11/1981 | Suzuki et al. | 164/254 |
| 4,515,204 | 5/1985 | Ohno | 164/483 |
| 4,605,056 | 8/1986 | Ohno | 164/490 |
| 4,664,176 | 5/1987 | Liebermann | 164/463 |
| 4,715,428 | 12/1987 | Johns et al. | 164/463 |
| 4,771,820 | 9/1988 | Williams et al. | 164/463 |
| 4,789,022 | 7/1988 | Ohno | 164/122.1 |
| 4,896,715 | 1/1990 | Honeycutt | 164/479 |
| 4,934,443 | 6/1990 | Honeycutt, III et al. | 164/479 |
| 4,945,974 | 8/1990 | Honeycutt, III | 164/479 |
| 4,957,155 | 9/1990 | Trnka | 164/482 |
| 5,074,353 | 12/1991 | Ohno | 164/122.1 |
| 5,184,666 | 2/1993 | Gillon et al. | 164/466 |
| 5,201,361 | 4/1993 | Grove et al. | 164/459 |
| 5,230,381 | 7/1993 | Nara et al. | 164/463 |
| 5,251,687 | 10/1993 | Ashok et al. | 164/479 |
| 5,299,625 | 4/1994 | ashok | 164/479 |

FOREIGN PATENT DOCUMENTS

| | | | |
|---|---|---|---|
| 56-1250 | 1/1981 | Japan | 164/423 |
| 60-15047 | 1/1985 | Japan | 164/429 |

*Primary Examiner*—Jack W. Lavinder
*Assistant Examiner*—I. H. Lin

[57] ABSTRACT

Insulators, heated to a temperature which prevents solidification thereon, are used to confine all but one side of a continuous flow of initially-liquid metal alloy until it is solidified. The remaining side is confined by a thermally conductive material which is cooled by means to provide for essentially unidirectional rapid solidification of the alloy flow. Operational control and product quality are enhanced by establishing and conditioning a surface film on the liquid metal to be cast by controlling the gaseous environment available to the liquid metal prior to contact with the thermally conductive chill. The method and apparatus can produce cast strip with minimal shrinkage porosity from alloys with wide freezing ranges. The cast product is suitable for producing wrought products of high quality. The method is particularly applicable to aluminous alloys.

13 Claims, 2 Drawing Sheets

METHOD OF AND APPARATUS FOR CONTINUOUS CASTING OF METAL

FIELD OF THE INVENTION

This invention relates to process and apparatus suitable for the continuous casting of metal, particularly aluminous metal. The term aluminous refers to metal which is composed of more aluminum than any other metal.

DEFINITIONS

The term "continuous casting" as used herein covers the continuous casting of strip of generally rectangular cross-section and also the casting of other cross-sectional shapes wherein the strip casting process methodology applies and it does not include semi-continuous casting as used, for example, to cast ingots. The terms "strip" or "casting" will be used to designate the cast product. Herein, the terms "surface film" and "oxide film" and "aluminum oxide film" are to be taken generally to include metal oxides, metal fluorides, metal carbonates, aluminum oxide, spinels, aluminum fluoride, complex metal hydrates and other surface films that form on metals and particularly aluminous alloys depending on the ambient conditions to which that surface is exposed. The term "gas", as used herein, will be understood to cover not only true gases but substances in a vapor phase. Herein, the term "thermally conductive" (conductor) materials refers generally to materials, such as metals or alloys, i.e. copper or stainless steel or to nonmetallics such as graphite or silicon carbide coated graphite, that is, materials with thermal conductivities greater than about 20 joules/meter sec °K. The terms "low thermal conductivity" or "insulator" both refer to materials such as Alfibond ® and insulating boards or refractory materials with thermal conductivities less than about 2 joules/meter sec °K.

BACKGROUND OF THE INVENTION

Prior Art

As is well known in the art, strip has been cast between moving blocks, moving rolls, moving bands, and moving wheels or combinations of those. Strip has also been cast on to singular moving devices as in drag casting. In these processes the moving devices all function, at least partially, as molds to shape the casting. The moving component or components also function to transfer heat in order to solidify, at least partially, the cast strip. Examples of such casters are the well known block caster, twin roll caster and belt caster. Examples illustrative of practice may be found in Lenseus et al's U.S. Pat. No. 3,623,535; Wood et al's U.S. Pat. No. 4,934,441; Honeycutt et al's U.S. Pat. Nos. 4,934,443 and 4,940,077; Honeycutt's U.S. Pat. No. 4,945,974 and U.S. Pat. No. 4,979,557; Key's U.S. Pat. No. 5,251,686 and Ashok et al's U.S. Pat. No. 5,251,687 as well as in the extensive literature. Strips have also been cast from stationary, open ended molds as exemplified by Moritz's U.S. Pat. Nos. 3,451,465; 3,623,536 and 3,463,220.

Continuous casters are used extensively to produce castings of relatively pure alloys generally those of low strength such as alloys for foil and those of high electrical properties for windings or redraw rod. There has been little interest in producing strong, highly alloyed materials by continuous casting because relatively large investments were already in place for ingot metallurgy production and because traditions and art were already established for the production of strong alloys from ingots. However, such equipment eventually grows old. The real advantages, both technical and economic, that rapidly-solidified metallurgical-structures provide to strong "specialized" alloys have become increasingly accepted by academics and increasingly desired by industrial and government users alike.

Strip and like shapes can be cast with freezing rates in the accepted zone of "rapid solidification" i.e., solidification structures which are equivalent to or finer than the metallurgical structures achieved by air atomization of the alloy. There are well known and obvious economic and technical reasons why, given the same or equivalent metallurgical structural benefits, it is more desirable to produce a sheet, wire or foil product from cast strip rather than from atomized powder or from spray deposited strip.

Many entrenched, production people object to the concept of casting strong, specialized alloys in strip form, particularly, if the strip is for further fabrication to wrought product. Among the reasons for objecting is that even a small., "hard alloy" caster will produce too much metal for the current market of any hard alloy (not mentioning that it may idle entrenched, large furnace, ingot production facilities and large ingot breakdown mills). A rarely expressed reason for objecting is that the development of casters effective for the production of high quality, highly alloyed product may produce a second generation of "Mini Mills" and cause serious changes in the overall industry.

The concept of premium strength alloy sheet and other products being produced from rapidly solidified, continuously cast strip is slowly coming to the fore. Importantly for the practice of this invention, a caster really does not have to run at very high speed. Current, conventional, continuous caster thinking currently has it that casters should be run "wide open" at ever increasing speeds. In the instant teachings, the continuous caster should run at a speed satisfactory for making the best metallurgical structure and quality consistent with reasonable control leeway and safety. The unique production method and apparatus of this invention produces a rapidly solidified cast strip with minimal shrink porosity providing a strip which strip is especially suited for further fabrication.

OBJECTS AND ADVANTAGES OF THE PRESENT INVENTION

The present invention can produce strip with minimal shrinkage porosity and with minimal segregation of low melting phases. Any detrimental volume of segregated low melting phases is found at surfaces and is not encapsulated within the casting. Alloys with freezing ranges above about 35° C. respond well. Better than acceptable results have been obtained with an alloy whose freezing range was over 90° C. at a thickness of about 1-cm when solidified unidirectionally by a water-cooled copper-chill below a superliquidus, heated insulator covering the top and sides of the solidifying strip.

The preferred mode of operation of the instant method is to produce as close to true unidirectional heat flow during solidification as possible. It has been found that stringent efforts towards this theoretical goal will markedly reduce or prevent the structural inhomogeneities associated with the meeting of solidification fronts within a casting. Many segregation related defects are avoided and, surprisingly and importantly, shrinkage porosity was markedly reduced by rapid, unidirectional solidification as taught herein. The castings produced by the instant invention are suitable for further processing to wrought, heat treated products which meet or exceed mechanical property limits for ingot metallurgy products of the same alloy.

By using unidirectional solidification and by maintaining a suitable speed of solidification, final-solidification-region-compositional-inhomogeneities are both limited in extent and are found at a free surface. The inhomogeneities are not disposed in a subsurface portion of the casting as is found in conventional continuous castings. Obviously, if it proves necessary or desirable, it is practical to remove an undesired or less desirable region of a casting if that region is a surface region. When metal is caused or allowed to reject heat of solidification in multiple directions, particularly when the metal has a freezing range above about 15° C., internal, compositional segregation will occur. The location of the region of segregation is dependent on the relation of the freezing rates from the various surfaces. Of course, it is less and less economically practical to remove undesirable regions of a casting the more deeply the undesirable region is embedded within the casting.

The present invention rests primarily on the novel combination of several fundamentals to produce improved strip casting results.

The fundamentals are listed below to aid in understanding:

(i) heat always flows from a higher temperature to a lower temperature.

(ii) a well formed oxide film on a liquid metal stream, particularly on an aluminous metal stream, can contain and confine that liquid stream and can even be used to direct that stream as long as the film is not broken.

(iii) solidified particles in a fluid metal stream can stick to cooler solid surfaces and such stuck particles can cause tears in an already formed oxide film on a liquid metal stream which stream then can become unconfined and drip or spill.

(iv) a fresh, metal surface, particularly an aluminous metal surface, will react chemically to produce a solid surface film with any oxidizing gas available. Such reaction will reduce the amount of oxidizing gas present which inevitably results in a lower local oxidation potential in that vicinity when oxidizing gas or vapor access to the region is limited or restricted.

(v) molten metal, particularly when covered by a surface oxide film, generally will not flow into sharp corners or into small holes or pores or fill small grooves but will form a meniscus rounding over or extending smoothly over such regions.

(vi) a fresh metal surface, particularly of aluminous metals, at casting temperatures can react with carbon and oxygen compound gases or carbon and fluorine compound vapors to form solid metallic compound films and carbon and, perhaps, metallic carbides and carbonates. In the presence of excess hot metal, the reaction products are solids without gas residuals.

(vii) a fresh, hot aluminous metal surface at casting temperatures will react with ambient air to form a surface film and, locally, to deplete oxygen and water vapor and carbon dioxide (and sometimes with nitrogen) but will leave at gaseous residue of unreacted gases such as argon, nitrogen, and the water reaction product hydrogen.

This invention mitigates problems encountered in strip casting related to shrinkage porosity and to non-uniformity of structure especially that caused by segregation of low melting phases into the subsurface of the casting. Practice of this invention can mean that cracking is more easily avoided during operation. The method and apparatus of this invention is particularly suitable for casting so called "hard alloys" i.e. alloys with a substantial semi-solid range, about 35° C. and more, between liquidus (fully molten) temperature and solidus (fully solid) temperature. The castings produced under the teachings of this invention are particularly suited for further fabrication into useful wrought products. In particular an aluminous "hard alloy" casting made according to the teaching of the instant invention has been further fabricated by hot working and heat treatment to a sheet product which product met or exceeded the mechanical properties typically generated by ingot metallurgy sheet from the same alloy. Conventional continuous casters using conventional methods usually have great difficulty producing castings of "hard alloys" and, when coherent strip is produced, the cast strip is not satisfactory for further fabrication to wrought, heat treated sheet or when sheet is produced, the sheet does not achieve typical, ingot metallurgy sheet mechanical properties.

BRIEF DESCRIPTION OF THE DRAWINGS

The foregoing and other features and advantages of the present invention will be apparent from the following detailed description taken in conjunction with the accompanying drawings, in which.

LIST OF REFERENCE NUMERALS

Figure 1:
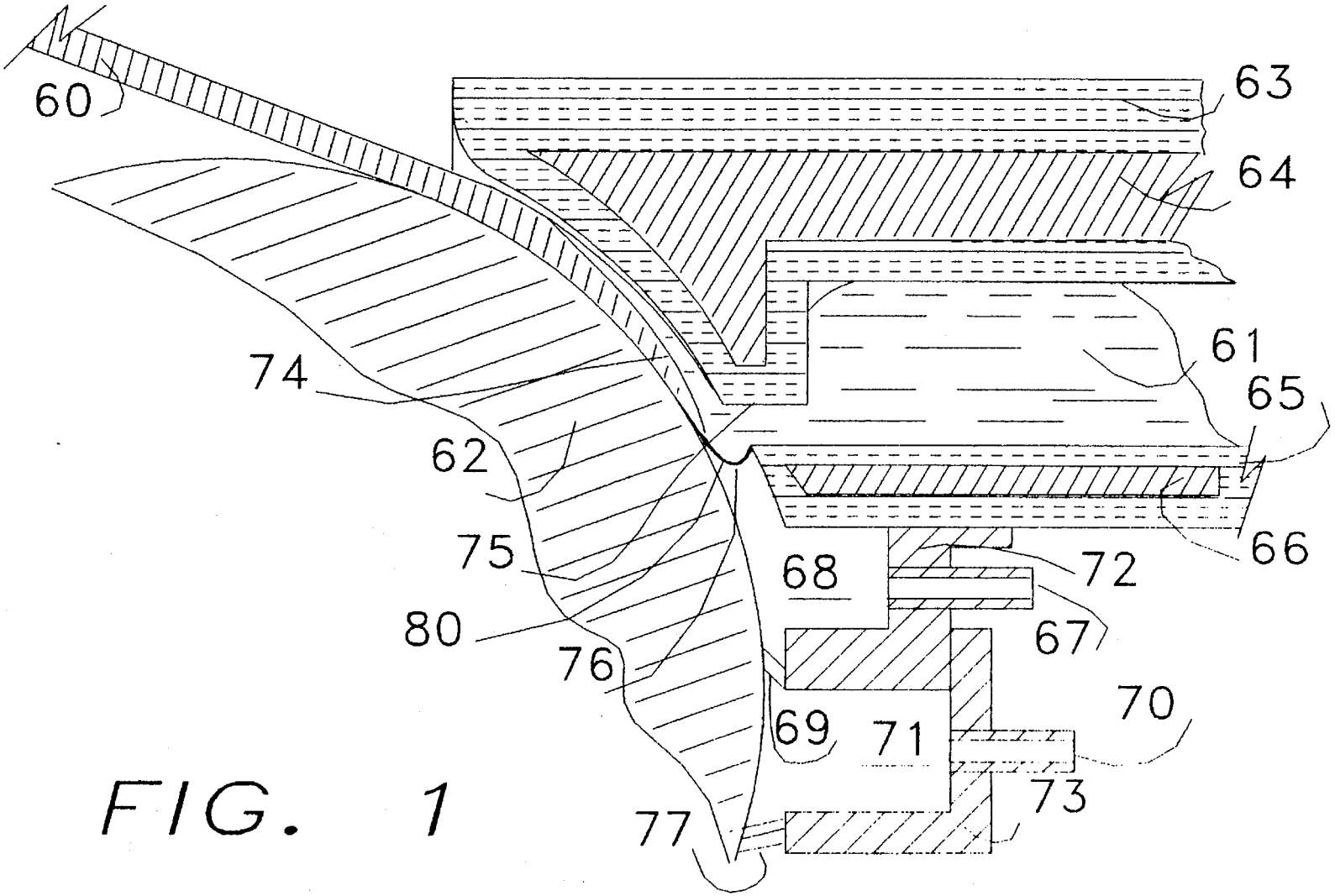
FIG. 1 is an elevation cross-section of a significant portion of a strip caster-2 in operation according to the invention.

40 strip caster-1 heated inlet nozzle integral with heated cover extension, 56, both made of a low thermal conductivity material

41 strip caster-1 conductive heat source

42 strip caster-1 conductive heat source

43 strip caster-1 conductive heat source

44 strip caster-1 conductive heat source

45 strip caster-1 heated wall of casting wheel mold trough made of an insulator

46 strip caster-1 conductive heat source

47 strip caster-1 conductive heat source

48 strip caster-1 heated base of casting wheel mold trough made of an insulator

49 strip caster-1 casting wheel body, in operation as shown, rotation is clockwise

50 strip caster-1 the gap between the end of the heated inlet nozzle and wheel trough mold at the far end of which gap a liquid metal meniscus forms

51 strip caster-1 gap between heated inlet nozzle cover extension 56 and movable conductive belt 52 at the for end of which gap a liquid metal meniscus forms

52 strip caster-1 a moveable, conductive, flexible belt through which heat is extracted to solidity the molten metal by means of a unidirectional flow of heat away from the casting

53 strip caster-1 a wheel used to drive, guide and tension belt, 52, in operation as shown, rotation is counter-clockwise

54 strip caster-1 a symbol used to indicate coolant is applied by known means to the belt, 52, while the belt is in contact with metal to be solidified (coolant source not shown)

55 strip caster-1 solidified metal

56 strip caster-1 heated trough cover, an extension from the inlet nozzle, an insulator
57 strip caster-1 liquid metal feed (source not shown)
60 strip caster-2 solid metal cast product
61 strip caster-2 liquid metal feed (source not shown)
62 strip caster-2 cooled conductive wheel used to extract heat unidirectionally from the metal being cast, in operation as shown, rotation is counter clockwise
63 strip caster-2 heated cover for the liquid metal feed, the strip being cast and the sides of the strip being cast and made from an insulator
64 strip caster-2 conductive heat source
65 strip caster-2 heated liquid metal led trough made from an insulator
66 strip caster-2 conductive heat source
67 strip caster-2 gas inlet (source not shown)
68 strip caster-2 gas plenum one
69 strip caster-2 surface wiper seals to retard or prevent gas flow made from an elastomer or from a graphite composite or the like
70 strip caster-2 connector pipe to gas plenum two
71 strip caster-2 gas plenum two
72 strip caster-2 a body forming gas plenum one between the liquid metal feed trough and the casting wheel
73 strip caster-2 a body forming gas plenum two between gas plenum one and the casting wheel
74 strip caster-2 designates a line symbolic of the semi-molten zone of metal between the liquid and solid phases
75 strip caster-2 an extended surface of the liquid metal cover which can be used to limit the volume of liquid metal having direct access to the cooling wheel and made from a heated insulator
76 strip caster-2 the metal meniscus formed in the gap between the liquid metal trough and the casting wheel
77 strip caster-2 surface wiper seals to retard or prevent gas flow made from an elastomer or a graphite composite or the like

DETAILED DESCRIPTION OF THE PREFERRED EMBODIMENTS

Strip Caster-2

FIG. 1 is an elevation cross-section of a significant portion of a strip caster-2 which is in operation according to the instant invention. Said strip caster-2, except for the significant details hereinafter described, is a conventional type of caster such as that shown in Honeycutt, Ill. U.S. Pat. No. 4,945,974 and U.S. Pat. No. 4,979,557 in which a metal strip is directly cast on a cooled, moving, conductive cylindrical surface commonly referred to as a wheel. The wheel acts as a continuous heat sink, mold and shaper of a major surface of the strip cast. Fully molten metal is usually provided to a location in the upper quadrant of the wheel where the direction of rotation of the wheel is towards the wheel top in order to utilize the force of gravity to hold the strip to the wheel.

The significant, novel details of the invention are shown in FIG. 1 in the proper functioning relationship to the features of a conventional strip caster, most of which conventional features are not shown. Referring to FIG. 1 the first of two novel features is a stationary, heated top cover and heated sidewalls, 63, which surround a strip, being cast on a wheel, 62, until the strip is solid. The top cover and sidewalls are maintained at a desired temperature by a suitable means such as an embedded heat source such as shown for the top section by 64. A heat source, 64, can be a thermally conductive material heated by electrical resistance elements and controlled at the desired temperature by suitable means. The heated section, 63, is an insulator which is stable at operating temperatures such as Alfibond ®. The insulator is preferably resistant to attack by the molten metal, may be non-wetted by the molten metal and may be covered on its inner surface by a thin coating such as graphite or silicon carbide which is not generally considered an insulator.

The purpose of this heated section, 63, is to operate at or above a temperature such that, at any liquid metal contact point, no solid will be caused to form from that contact. Formation of solid not only disrupts unidirectional solidification but, importantly, can cause sticking of the solid to the wall which disrupts flow and contributes to undesirable structures in the strip. By means of the heated cover and sidewalls, 63, a strip, 60, is forced to solidify unidirectionally rejecting heat of solidification only to a casting surface of cooling wheel, 62 (internal and surface details not shown). Because of the low heat conductivity of the insulator, 63, only a negligible amount of heat (compared to that for solidification) will be transferred from this hotter section to the liquid, semi-solid or solid metal in contact or near contact with the insulator. Solidification shrinkage and gravity will together tend to cause the upper and side surfaces of the strip to loose contact with section, 63 as the casting solidifies.

The top and side wall cover, 63, is extended back in the liquid feed stream direction as along surface designated 75 and desirably over the top of at least the end portion of a liquid metal feed trough, 65, to which section, 63, is mated and which together form the stationary liquid handling equipment.

A heated, liquid-metal, feed trough, 65, carries: a suitable supply of liquid metal, 61, (supply not shown). The feed trough, 65, is constructed of insulating material resistant to the molten alloy being cast and, desirably, heated for example, as is section, 63, by similar heat sources one of which is shown as 66. Heated sections surrounding the incoming liquid metal feed help provide for a more thermally consistent feed to the caster.

This first novel feature which comprises a super-liquidus heated-insulator top and sidewall cover for the strip being formed on the casting wheel is a useful improvement to the art in and of itself when used alone, but it is more useful in combination with the second novel feature described below.

A second novel feature is a means to supply an oxidizing gas of controlled composition to metal menisci formed between the stationary liquid handling equipment, cooperating surfaces of members 63 and 65, and a moving surface of cooling wheel, 62. Again, referring to FIG. 1 gas plenum-1 body, 72, is shown positioned at the bottom of the liquid metal supply trough, 65, with seals 69 against the surface of the casting wheel, 62. This gas plenum-1 body extends the full width of the supply trough, 65, and extends to cover the width of similar plenums (not shown)on each side of section 63. Gas plenum-1, 68, is fed with gas from inlet, 67, from a source (not shown). A variant construction (not shown) places an additional seal, or a partial seal such as is made from a gas porous material, made from a material such as carbon or graphite between the wheel surface and the feed trough bottom, 65. Gas plenum-1 may have a second opening (not shown) such as inlet, 67, which may act as an inlet or an outlet as desired for better control, as is known in the art, of the atmosphere in plenum-1.

It is advantageous, particularly when a substantially smooth surfaced casting wheel is used or when casting speeds are high, to provide a second gas plenum-2 covering the same surface width of casting wheel as the first gas plenum-1. In FIG. 1 gas plenum-2, 71, is formed by plenum-2 body, 73 and the wheel surface and seals, 69 and 77. One of two connections into the plenum is shown as 70. Gas plenum-2 can serve in one of two modes. In a first mode, a desirable gas or gas mixture is passed through plenum-2 to replace, to the extent possible, such ambient atmosphere as is dragged in by the surface of moving wheel, 62. In a second mode the plenum is evacuated to a partial vacuum to remove, to the extent practical, the ambient atmosphere dragged in by the surface of moving wheel, 62, as well as such gas as seeps through the seal from plenum-1 and acts much as a purge gas. Hence, the purpose of plenum-2 is to prepare the surface of the wheel to receive a desirable gaseous atmosphere provided in plenum-1.

The purpose of plenum-1 is to provide a gas or gas mixture of choice on both the surface of the wheel, 62, that will be cast upon and to condition the surface of the menisci of liquid metal. Only the bottom meniscus, 76, is shown. Conditioning of the menisci provides a controlled surface film 10 on the liquid metal.

For a substantially smooth (surface roughness less than about 0.006-mm) surfaced casting wheel, the desired gas will be one which can react with the nascent metal in the meniscus to produce only solid reaction products such as carbon dioxide or various fluorinated carbon compounds. Thus, gas pockets interfering with heat transfer between the metal and the cooling surface will be much less likely to form or, if formed, may exist for only a short time since, surrounded by an excess of metal, reaction is likely to exhaust the gas pocket.

If the surface of the casting wheel has been turned only roughly (surface roughness more than about 0.01-mm) or has been purposefully grooved to provide for gas escape and, in both cases, lowered heat transfer than provided by a substantially smooth surface, then it may be desirable to provide for a suitable amount of inert gas mixed with an oxidizing gas in plenum-1 so that an unintended low pressure (resulting from surface film formation reaction with the gas atmosphere) will not be generated in the grooves. A localized low pressure may induce liquid metal to enter rather than bridge over the grooves; bridging is usually desired.

The remaining features shown in FIG. 1 are conventional and include the molten metal to be cast, 61, semi-solid metal symbolized by the line, 76, and solidified metal, 60, the product strip. Other necessary or desired features are those that are common to conventional apparatus using conventional methods and are not shown.

Strip Caster-1

Figure 2:
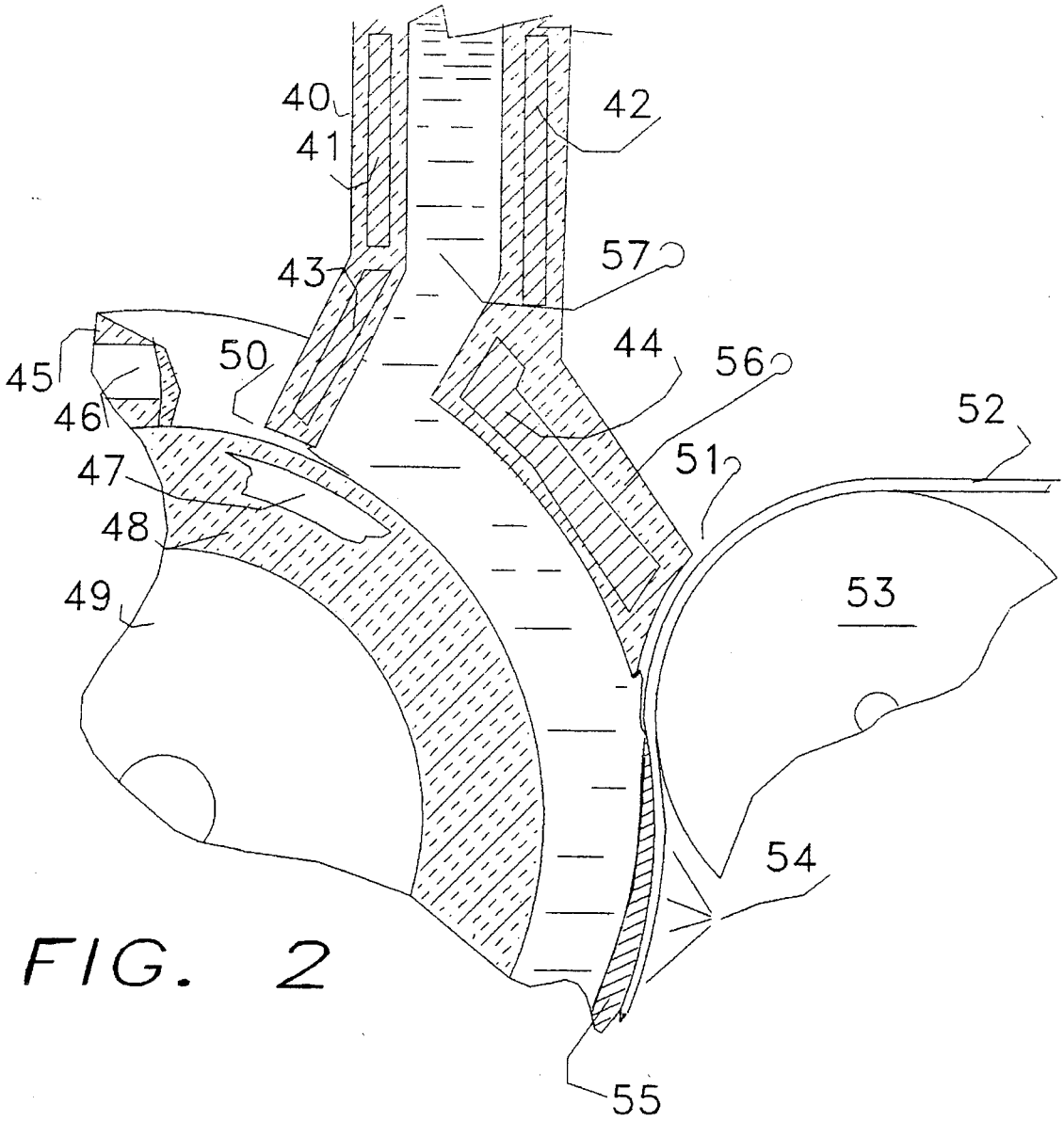
FIG. 2 is an elevation cross-section of a significant portion of strip caster-1, another type of strip caster, in operation according to the invention.

FIG. 2 is an elevation chess-section of a significant portion of strip caster-1 in operation according to the invention. Said caster, except for significant details hereinafter described, is of a conventional type the remaining conventional details and essential elements not being shown. Such a conventional caster is exemplified by Lenseus et al's U.S. Pat. No. 3,623,535; that is, it consists of a molten metal supply pouring downwards into a mold cavity formed between a moving wheel containing a cavity in its surface and a synchronized moving belt pressed against the wheel so as to contain the molten metal until it is solid enough to be dimensionally constrained to a desired shape. The liquid metal entry is usually an upper quadrant in the direction of the wheel's motion to the bottom of the wheel and the exit is usually from a diametrically opposite quadrant of the wheel to the entry. These casting systems, such as the Properzi system, are well known and are usually designed and operated to produce, castings at high speeds for direct feed to continuous rolling mills especially for the production of conductor wire from metal with only small alloy content and, thus, of small freezing range.

The purpose of the instant invention is to change fundamentally the current concepts of this type of caster such that the cast product is unidirectionally solidified for the advantages previously enumerated. In addition the system of the present invention will permit casting of "hard alloys", that is, alloys having substantial freezing ranges which require high quality cast structures to achieve the superior mechanical strengths for which such alloys were designed.

In the conventional casting operation the wheel is cooled and the exterior of a confining belt is cooled with copious amounts of a coolant such as water. A casting may exit the wheel with its center still in a mushy or liquid condition and may receive additional exterior cooling, as referenced above, to complete solidification and adjust temperature.

The significant, novel details of the invention are shown in FIG. 2 in the proper functioning relationship to conventional features. Referring to FIG. 2, a first of two novel features is the periphery, 45 & 48, of the interior rim of wheel, 49. This rim is not cooled nor is it a good thermal conductor but the periphery is formed of an insulator which may be heated as is shown by good thermally conductive blocks, 46 & 47, with imbedded resistance heaters and controlled by suitable means. Alternatively the trough rim-section of the casting wheel may be heated by any suitable conventional means during its travel from after product metal exit (not shown) to slightly before the beginning of the molten metal feed spout, 50. The liquid metal feed, 57, (source not shown), is fed to the casting wheel trough through a insulated supply section, 40, and trough mold extension cover, 56. These sections may be, as shown, heated by conductive heat sources 41,42, 43 & 44 which may be heated by electrical resistance and controlled to a desired temperature, as is well known in the art, or by other heating means. The purpose of the heated wheel trough is to prevent the metal being cast from transferring heat of solidification to the trough. If metal does not solidify by contact with the trough, and if there has been a well formed surface film on the metal in contact with the trough, then the metal being cast will not stick to the trough. The cast metal, subjected to gravity and rotational forces, will maintain good thermal contact with the cooling belt.

If the desired casting is to be thicker than about 2-cm, then a useful variant is the introduction of a controlled, cooled, conductive, e.g. graphite, surface into the stream of liquid metal flowing down into the trough whereby a small amount of metal may be solidified and then swept away and some of the liquid superheat is removed causing the cast structure to be more homogeneously nucleated than otherwise.

The flexible, thermally conductive belt, 52, has its outer side cooled with as efficient cooling means as practical. The belt may be solid or it may be partially open as, for example, woven and of a sufficiently fight weave that oxide covered metal will not penetrate the weave. The beneficial result is that the cast section is unidirectionally solidified such that there is no longer a central region of inferior structure. If the surface structure of the last portion of the section to solidify is not fully desirable for some applications, the undesirable portions of the surface can be scalped away without great harm to the overall economics of the process. The use of an other than solid, conductive belt is believed to mitigate the thermal stresses and thermal fatigue that adversely affect belt life.

The second novel feature is that a gas plenum assembly(s), of the type previously described and shown in FIG.

1, may be located to cover the gap and metal meniscus noted in FIG. 2 as 51 and, also cover the gap along the top of the wheel's trough-mold wall. In this operation the purpose of the gas plenum assembly at region 51 is to substitute for ambient atmosphere a desired surface oxide forming, reactive gas on and above the belt surface just prior to and during contact of the molten metal with the belt. The use of a gas such as carbon dioxide (which can react with an excess of metal to form solid products) as the desired reactive gas will eliminate or greatly reduce gas pockets which otherwise tend to form between a solid belt and the cast metal as a result of dragged-in gas-environment. Gas pockets are undesirable because they reduce heat removal in intermittent locations which produces less homogeneous metallic structures and, overall, less refined structures. If a woven belt is used, the gas plenum assembly at region 51 is needed to establish a confining surface film over the nascent, liquid metal prior to metal contact with the woven belt.

A gas plenum assembly is also useful on the internal sides and bottom of the wheel trough gap at 50. That plenum is also fed advantageously with an oxidizing gas such as carbon dioxide or the like to provide a conditioned, encapsulating surface film and provide for easy release of the casting from the wheel. Easy release of the casting from the wheel trough permits best contact of the freezing metal with the flexible belt which retains a fast solidification rate and promotes a homogeneous structure. A partially solidified casting may be removed from the wheel and unidirectional solidification continued in a second section much as is practiced in conventional casting operations, except that the casting, following the teaching of the present invention, would be covered on the top and both sides by properly hot insulators until solidification was complete.

The other items shown in FIG. 2 are those to be found in a conventional caster such as a belt tensioning and controlling wheel, 53, a cooling means for the belt indicated by the symbol at 54, and the beginning of solid metal production shown as 55. Belt control wheel, 53, rotates counter clockwise in operation and the casting wheel, 49, rotates clockwise. Tension by other wheels (not shown) keep the flexible belt taut against the casting wheel wall ends. Other necessary or desired features are those that are common to conventional apparatus using conventional methods and are not shown.

OPERATION OF THE INVENTION

Strip Caster-2

Referring to FIG. 1 the strip caster is fed with fully molten metal in the feed trough, 65, with the objective of producing a product cast strip, 60, which has been unidirectionally solidified. As is novel to the instant invention, the final passage of the liquid metal prior to contact with the surface of the chilled casting wheel, 62, is through the heated insulator trough and under the heated insulator cover and sidewalls. The heaters in the insulator are operated at temperatures preferably above the liquidus of the alloy being cast such that no metal contacting the insulator can reject heat of solidification to the insulator and freeze thereon or thereby.

The speed of operation of the wheel, 62, which as shown in FIG. 1 rotates counter-clockwise, is controlled such that solid does not form in the region formed by the gap below surface, 75 and above the trough bottom 65. (A suitably placed thermocouple, arranged so that it is not a cooling source, can serve to warn of incipient freezing.) The maximum speed of operation is desirably limited to a speed which will produce fully solidified strip prior to exit from under the heated top cover, 63 unless there is a special need for a not fully solid surface exiting the caster cover.

Again referring to FIG. 1, the use of a specific gas or gas mixture in gas plenum-1, 68, can act to enhance operation of the caster. If the casting wheel, 62, has a surface which permits operation under conditions which tolerate the wheel surface to drag in gas atmospheres, then the control of the caster operation can be enhanced by providing a controlled gaseous environment such as an inert gas (e.g. nitrogen, argon or helium) with about 10 to 30 volume % oxygen. As is known, dry gas, dew point less than about 0° C., preferably less than −20° C. reduces hydrogen pick up when reacting with an aluminous melt, if water vapor above a 0° C. dew point is present it must be below the condensing point and hydrogen pick up is retarded or avoided by the presence of 10 to 20 v% carbon dioxide; any amounts of sulfur oxides should be avoided as they enhance hydrogen pick up by the melt. The purpose of the gas plenum operation is to provide a stable controlled environment that will produce a stable strong surface film over the metal menisci. The controlled gas environment composition should be adjusted to fit with alloy composition, particularly the amount of the elements from Group IA and IIA of the Periodic Table of Elements. Process control can be enhanced by use of measurement data such as the position across the casting width of the bottom meniscus, 76, and the reflectivity values which measurements may be routinely and continuously made without physical contact, as is well known to the art. The controlled gas environment in gas plenum-1 may be able to be controlled to a desired steady state simply by control of flow to the plenum or an exit may be needed to such as a simple silicone fluid filled bubbler so that a low but positive pressure purge may be maintained.

Referring again to FIG. 1, gas plenum-2, 71, may be operated in conjunction with gas plenum-1, 68. Gas plenum-2 may be operated, as is well known in the art, as either a vacuum pretreatment system or as a positive pressure purge chamber to dilute and remove ambient gases brought in by the surface of wheel, 62, prior to that surface passing into gas plenum-1.

For operation with a caster with a smooth surfaced wheel, 62, gas plenum-1 is preferably protected by gas plenum-2 and the controlled gas is preferably selected from a gas that will react with the metal being cast to produce only solid reaction products. Particularly for aluminous alloys example gases are compounds of carbon with oxygen or fluorine. The use of a smooth surfaced casting wheel can provide greater heat transfer from the metal being cast thus permitting production rate advantages. A smooth surfaced wheel may have its surface either as solid or as coated with a substance that can be either or both liquid and solid during a revolution of the casting wheel. Such a coating can be composed of such materials as sodium, sulfur, lead, bismuth or lead-bismuth alloys, said coating preferably being lower melting than that of the alloy being cast and immiscible with the alloy being cast but wetted or mechanically locked to the wheel surface.

Strip Caster-1

The strip caster illustrated in FIG. 2 is operated to unidirectionally solidify a cast product by rejecting heat of solidification to a cooled, conductive flexible belt, 52. In operation the flexible belt, 52, moves with the belt control wheel, 53, in a counter clockwise rotation as shown and the casting wheel, 49, rotates in a clockwise direction and has a peripheral trough which, in combination with the belt tensioned against its wall ends, forms the mold for the casting, as is well known. Liquid alloy to be cast, 57, flows into the beginning of the mold through a downcomer inlet feed nozzle, 40, and passes through a channel formed by the cover extension, 56, and the heated rim trough, members 45 & 48 being shown of wheel, 49. These heated members are all made from insulators and are heated by heat sources operating at temperatures preferably at or above the liquidus of the alloy being cast so as to prevent heat of solidification being rejected to these members. The low thermal conductivity of the members functions to restrict the amount of heat that can flow to the metal being cast such that the solidification of the casting is not retarded to a significant degree nor is an unreasonable amount of energy required.

The flexible belt, 52, has good thermal conductivity:y and may be smooth and solid or the belt may be smooth and have small openings through which oxide film covered metal, even under the feed head, will not penetrate. Such openings may be provided by a woven belt with a woven texture that is effectively smooth to the oxide skin covered liquid metal flowing thereon. The advantage to using a flexible belt which is not completely solid is that such a belt can be more resistant to the life-shortening detrimental effects of thermal shock and fatigue which are typically harsh in a belt caster environment and such openings can provide for improved heat transfer from the casting to the primary coolant being delivered to the belt shown symbolically by, 54, and as is known and practiced in the art.

In order to be able to use a belt with openings it is advantageous to control the surface oxide film on the metal surface that will be against the belt, 52. In order to provide oxide film control, a gas plenum system of the type shown and described with FIG. 1, above, may be situated between the cover extension, 56, and the open surface of the belt, 52, fully covering the gap, 51. As discussed previously, operation of the gas plenum(s) can control the oxide skin formed on the meniscus of nascent liquid metal, in this case the surface film formed on the meniscus at the bottom of gap, 51, prior to contact with the conductive, flexible belt, 52.

It is also desirable to control the characteristics of the oxide film/formed against the mold forming sections of the casting wheel, 49. Again oxide film control may be attained by using the gas plenum system described above. A stable oxide film formed on the metal to be cast will contribute to easy release of the casting from the wheel as solidification shrinkage occurs. This easy release is required so that contact between the casting; and the cooling belt is maintained by gravitational force and, perhaps, by rotational forces. A suitable oxide film over the trough region of the liquid stream can enable a not-fully-solidified casting to be taken from the wheel without losing dimensional control. In the case of the present invention additional cooling would be under a heated cover for completion of the unidirectional solidification. Removal of a not-fully-solidified castings from casting wheels to a supported cooling system is well known as evidenced by Ashok et al U.S. Pat. No. 5,251,687 and Lenseus et al U.S. Pat. No. 3,623,535.

It is obvious that limiting the cooling to unidirectional cooling will slow production compared to that of conventional casters of this type which attempt to freeze from all sides. However, the advantages of unidirectional solidification in producing more uniform metallurgical structure, reducing shrinkage porosity and forcing any gross segregation to exterior surfaces are worthy advantages which are believed to outweigh reduced production rate.

Example of the Benefits of Using Heated Insulators in Casting

The hot insulator technique contributes a negligible amount of additional cooling load on the process and contributes to the production of sound castings. For example, casting as strip: an aluminum alloy containing about 6% copper, 0.2% manganese and 0.2% magnesium and small amounts of zirconium and vanadium was poured from a melt at about 790° C. into a strip about 1.3-cm thick and chilled by a water cooled copper chill unidirectionally. The strip was surrounded on both sides and its top by an insulator heated to about 690° C. The strip solidified at a rate faster than 10° C./sec (based on the observed dendrite arm spacings of less than 20-micrometers in the etched solidified casting and the correlation published in "Aluminum: Properties and Physical Metallurgy", Edited by John E. Hatch, ASM Metals Park, Ohio, 1984, FIG. 4, page 37). That reference indicated that such a solidification rate is, by an order of magnitude, well into the solidification rate attributable to gas atomization of aluminum alloys; hence satisfactory for a strip casting process. The alloy was of the 2×19 type which has an accepted freezing range of 100° C. Optical microscopic observations at 100 times of polished cross-sections of the casting showed that there was very little shrinkage porosity, far less than would have been expected in a conventional drag cast alloy with a freezing range of less than half that of 2×19 type alloy.

Thus, it is safe to conclude that the hot insulator technique as described for continuous casting apparatus in this specification serves to permit practically true unidirectional solidification with negligible detriment to solidification rate and much less shrinkage porosity than is found in strip cast by conventional techniques which, intentionally or not, cool and solidify from two or more sides.

Conclusion and Scope of Invention

The reader can see that, in the casting of strip, the use of heated insulators (to prevent solidification thereto) to confine a moving flow of metal on all but one side during solidification of the flow by heat transfer through a single, major surface provides for unidirectional solidification and the attendant advantages of no central zone segregation, and minimal shrinkage porosity. Operational control leeway is improved when provisions are made for establishment and control of the surface film on the liquid metal by control of the gaseous environment over the metal just prior to contact of the metal to be cast with the cooling surface.

It is possible to achieve results superior to those of conventional casting systems with many alloys when the heated containment insulators are heated to a temperature above the solidus temperature of the alloy being cast but not necessarily above the true liquidus. Production of a saturated (i.e. not oxygen deficient) oxide film on the alloy being cast, particularly an aluminous alloy, prior to initial contact with the chill has been indicated to aid in tolerance of or prevent limited formation of primaries and the primaries sticking and releasing from the insulators, which happenings are believed to contribute to undesirable metallurgical structures in the product. Tolerance for less than liquidus-temperature heated insulators seems to apply to alloys with very wide solidus - liquidus ranges caused by low concentrations of elements which form primary compounds with high liquidus temperatures such as $Al_3Zr$. Further, from a practical standpoint, it is extremely difficult to determine the true liquidus temperature of many alloys. Hence, herein, temperatures above the liquidus may be practically defined as being above the major liquidus break as determined by a cooling curve when cooling the alloy at a rate of about 5° C./minute.

The reader can see that the casting process improvements described herein provide for improved product quality and ease of operation for continuous casting of metal, particularly aluminous metal, strip or the like by a method and apparatus herein disclosed and which is based on a novel combination of fundamental principles. While the above description contains many specificities, these should not be construed to limit the scope of the invention, but rather as an example of preferred embodiment thereof. Many variations are possible as have also been noted above and as will be obvious from the above recitations to those skilled in the art. Accordingly the scope of the invention should be determined by the appended claims and their legal equivalents rather than the specific embodiments given above.

I claim:

1. An apparatus for continuous casting of a metal alloy, said apparatus comprising:

at least one heated insulator member having a heating means therein; said at least one member having a molten metal confining heated surface;

a major member having a thermally conductive casting surface for casting metal thereon adapted to conduct heat from a liquid metal alloy being cast, said major member being in proximity to said at least one member to form an elongated, three-dimensional section having at least two boundary surfaces and at least two open ends;

wherein said heated surface and said thermally conductive surface provide said at least two boundary surfaces of said elongated, three-dimensional section such that said elongated, three-dimensional section has a single heat conductive surface.

2. The apparatus as claimed in claim 1, further comprising means for feeding said liquid metal alloy and removing said cast product through said elongated, three-dimensional section.

3. The apparatus as claimed in claim 1, wherein said major member a rotatable cylinder and said thermally conductive surface comprises a cooled surface of said rotatable cylinder.

4. The apparatus as claimed in claim 1, wherein at least one of said at least one member and said major member are moveable members.

5. The apparatus as claimed in claim 4, wherein said elongated, three-dimensional section comprises four boundary surfaces;

wherein said at least one heated insulator member comprises a rotatable wheel having a trough and two trough rims, said trough comprised of a trough base and two trough sides each having a heated insulator surface so that said rotatable wheel provides three of said four boundary surfaces of said elongated, three-dimensional section; and wherein thermally conductive surface of said major member provides one of said four boundary surfaces of said elongated, three-dimensional section so that said elongated, three-dimensional section has said single heat conductive surface.

6. The apparatus as claimed in claim 5, wherein said major member comprises a flexible, thermally conductive belt.

7. The apparatus as claimed in claim 6, wherein said belt is tensioned against an outer surface of each of said trough rims and over at least one quadrant of said rotatable wheel.

8. The apparatus as claimed in claim 1, further comprising a means for supplying said liquid metal alloy to said elongated, three-dimensional section, said means for supplying liquid metal alloy being proximate to said elongated, three-dimensional section so that at least one gap is formed between said means for supplying and said elongated, three-dimensional section.

9. The apparatus as claimed in claim 8, wherein said means for supplying a liquid metal alloy provides said liquid metal alloy so that at least one liquid metal meniscus is formed in said at least one gap.

10. The apparatus as claimed in claim 9, further comprising at least one gas containing plenum, said at least one gas containing plenum covering a surface of said at least one liquid metal meniscus with a means to substantially provide a predetermined gaseous environment within said plenum and control a surface film formed on said liquid metal meniscus.

11. A process of continuous casting of a metal alloy, comprising the steps of:

aligning a major member and at least one heated insulator member to form an elongated, three-dimensional section, said at least one heated member having at least two boundary surfaces and at least two open ends; said at least one heated member having a molten metal confining heated surface and said major member having a thermally conductive casting surface for casting metal thereon;

feeding liquid metal alloy into said elongated, three-dimensional section; and solidifying said liquid metal alloy within said elongated, three dimensional-section from a single direction with said major member to form a cast product with minimal solidification shrinkage.

12. The process as recited in claim 11, wherein said step of solidifying comprises casting a liquid metal alloy with a freezing range greater than 35° C.

13. The process as recited in claim 11, wherein said step of solidifying further comprises conducting latent heat of solidification in a direction generally perpendicular to an interface between said liquid metal alloy and said cast product within said elongated, three-dimensional section.

* * * * *